US005205711A

United States Patent [19]

Raczykowski

[11] Patent Number: 5,205,711

[45] Date of Patent: Apr. 27, 1993

[54] HAND-PORTABLE FIRE FIGHTING POSITIVE PRESSURE BLOWER

[75] Inventor: Daniel G. Raczykowski, Cheney, Wash.

[73] Assignee: Unifire Power Blower, Inc., Spokane, Wash.

[21] Appl. No.: 843,464

[22] Filed: Feb. 28, 1992

[51] Int. Cl.[5] ..... A62C 39/00

[52] U.S. Cl. ..... 416/63; 417/234; 169/52; 169/91

[58] Field of Search ..... 416/63, 235, 243, 246; 417/234; 169/91, 52

[56] References Cited

U.S. PATENT DOCUMENTS

| | | | |
|---|---|---|---|
| 2,035,479 | 3/1936 | Hueglin | 416/235 |
| 2,176,325 | 10/1939 | Bretzlaff et al. | 416/243 |
| 2,215,035 | 9/1940 | Gundelfinger | 416/246 |
| 2,633,293 | 3/1953 | Jones | 417/234 |
| 2,884,075 | 4/1959 | Poon | 169/52 |
| 2,954,198 | 9/1960 | Lindberg et al. | 416/246 |
| 4,682,729 | 7/1987 | Doman et al. | 239/2.2 |
| 4,906,164 | 3/1990 | Jackman et al. | 416/63 |
| 4,907,654 | 3/1990 | Eberhardt | 169/70 |
| 4,949,591 | 8/1990 | Roelle | 74/531 |
| 4,976,319 | 12/1990 | Eberhardt et al. | 169/54 |
| 5,062,487 | 11/1991 | Siria et al. | 169/52 |

OTHER PUBLICATIONS

Advertisement or product announcement; "Gasoline Powered Smoke Fans", date unknown.

Advertisement or product announcement: "New Product Update—LifeJack's The PPV," date unknown.

Advertisement: "Typhoon," Mar. 1989.

*Primary Examiner*—Edward K. Look

*Assistant Examiner*—Michael S. Lee

*Attorney, Agent, or Firm*—Wells, St. John, Roberts, Gregory & Matkin

[57] ABSTRACT

A hand portable positive pressure blower for fire fighting is described which includes an engine 10 with a drive shaft 12 mounting a propeller 16 within a propeller guard 22. This assembly is rigidly mounted to a central frame 27 that itself is rigid and extends about the engine. The central frame 27 is mounted by pivots 47 to a rigid support frame 37 for movement about a fixed adjustment axis 50. An adjustment means is provided to enable selective angular positioning of the central frame about the adjustment axis. The support frame 37 is mounted on rubber feet 42, 43 at integral pairs of forward and rearward legs 38, 39. The legs 38, 39 are angularly oriented with respect to the adjustment axis. Distances from the feet to the adjustment axis and the angular relationship of the blades promotes a secure footing for the blower and a compact configuration to facilitate transport and storage. The propeller includes a unique dished configuration on forward surfaces inward of blade ends to facilitate production of a wide cone of air current emitted from the blower during operation.

17 Claims, 5 Drawing Sheets

HAND-PORTABLE FIRE FIGHTING POSITIVE PRESSURE BLOWER

TECHNICAL FIELD

This invention relates to fire fighting equipment and more particularly to hand portable fire fighting, positive pressure and ventilation blowers.

BACKGROUND OF THE INVENTION

It has been found that positive pressure ventilation of structures sustaining an internal fire has many advantages. Positive pressure ventilation techniques are used to quickly remove smoke from the area to reduce smoke damage. Perhaps more importantly, the rapid removal of smoke and cooling of the inflamed area dramatically increases fire fighting safety. Firemen entering the structure will have considerably greater visibility and are more able to rapidly locate hot spots without having to crawl on the floor. Speedy removal of smoke and the replacement with cool air allows breathing apparatus to be removed earlier. Overall physical stress of fire fighters is reduced with fewer stress related injuries. This all results in greater fire fighting productivity.

To be able to obtain the above advantages, lightweight portable positive pressure blowers have been developed that may be easily maneuvered into position in front of an opening to a burning structure. Such a blower is disclosed in U.S. Pat. No. 4,906,164. The blower disclosed therein has substantial benefits in producing a positive ventilating pressure for fire fighting. The disclosed blower is easily transported and stored on a fire fighting vehicle. However, the adjustment capability for the blower is a relatively complex mechanism and is situated toward the ground surface. A hand crank is provided to change the angular position of the blower by pivoting forward legs that are provided independently of rearward, rigid supporting legs. The engine, propeller, and housing are connected rigidly to the rearward legs while the forward legs pivot to change the angular orientation of the blower. By pivoting the forward legs, the "foot print" of the ground engaging pads changes. As the angular position of the blower increases from the horizontal, the longitudinal spacing between the forward and rearward "feet" becomes shorter.

U.S. Pat. No. 5,062,487 discloses a similar blower arrangement and frame structure but with the provision of nozzles for connection to a source of water under pressure. The nozzles introduce a mist of water in the airstream to obtain additional benefits in cooling in moistening the air moving toward the "hot spots".

A misting fire ventilation blower is commercially available through the Hale Fire Pump Company of Conshohocken, Pa. The device is sold under the trademark, "TYPHOON". It includes a water turbine driven positive pressure ventilation system with an on demand water mist injector. The blower, turbine, blade, and housing is pivoted on a supporting frame. The pivot axis from the frame passes substantially through the center of the motor. The elevation from the ground or supporting surface to the pivot axis represents a substantial moment arm against which the thrust from the fan operates.

Other blower arrangements have been provided in which the blowers pivot about axes transverse to the blower fan blade rotation axes. The pivot axes are positioned at substantial elevations in relation to the ground surface. Thrust from the blowers has a tendency to render the blowers unstable, and vibration from the driving motors or engines plus the thrust from the fans cause the blowers to "walk" or move about during use.

The fans of prior blowers used for producing positive ventilation air pressure typically develop a narrow cone shaped airflow, due to the conventional shape of the fan or propeller blades. It has been found desirable to seal the air passageway with positive air pressure to avoid undesired and unpredictable exchange of air from within the affected structure through the air entry opening (usually a doorway or window). To create the "seal" prior blowers were positioned far enough from the structure that the air flow cone produced would be large enough at the entry to span the opening and effect the desired seal. This seemingly effective solution is not without drawbacks. An airstream will loose much of its energy and dissipate over distance. The airstream is thus diminished at the critical area within the structure.

A need therefore remains for a positive pressure ventilation blower that can be placed close to an opening yet that will both effect a "seal" about the entry and that will deliver a strong, effective current of air to the desired area within the structure. There is further need for a blower that is compact and in which provisions are made to absorb the forms of vibrational energy which have the tendency to cause other forms of blowers to "walk" or move about during operation, especially on wet or icy support surfaces.

One of the objects of the present invention is therefore to provide a compact, hand portable positive pressure blower that can be easily stored on a fire fighting vehicle, that will be stable in use and that will not have a tendency to "walk" due to thrust and vibration.

Another object is to provide such a blower that has capability to produce a wide cone airstream at close proximity to the propeller thereof.

A further object is to provide such a blower in which angular adjustment of the airstream is achieved quickly and easily.

A still further object is to provide such a blower that includes a supporting framework that will protect both the propeller blade and the engine during transport and use.

These and still further objects and advantages will become apparent upon reading the following description which, taken with the accompanying drawings, describe a preferred form of the present invention.

BRIEF DESCRIPTION OF THE DRAWINGS

A preferred embodiment of the invention is illustrated in the accompanying drawings, in which:

FIG. 7 is a fragmented plan view of the adjustment mechanism shown in FIG. 6.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
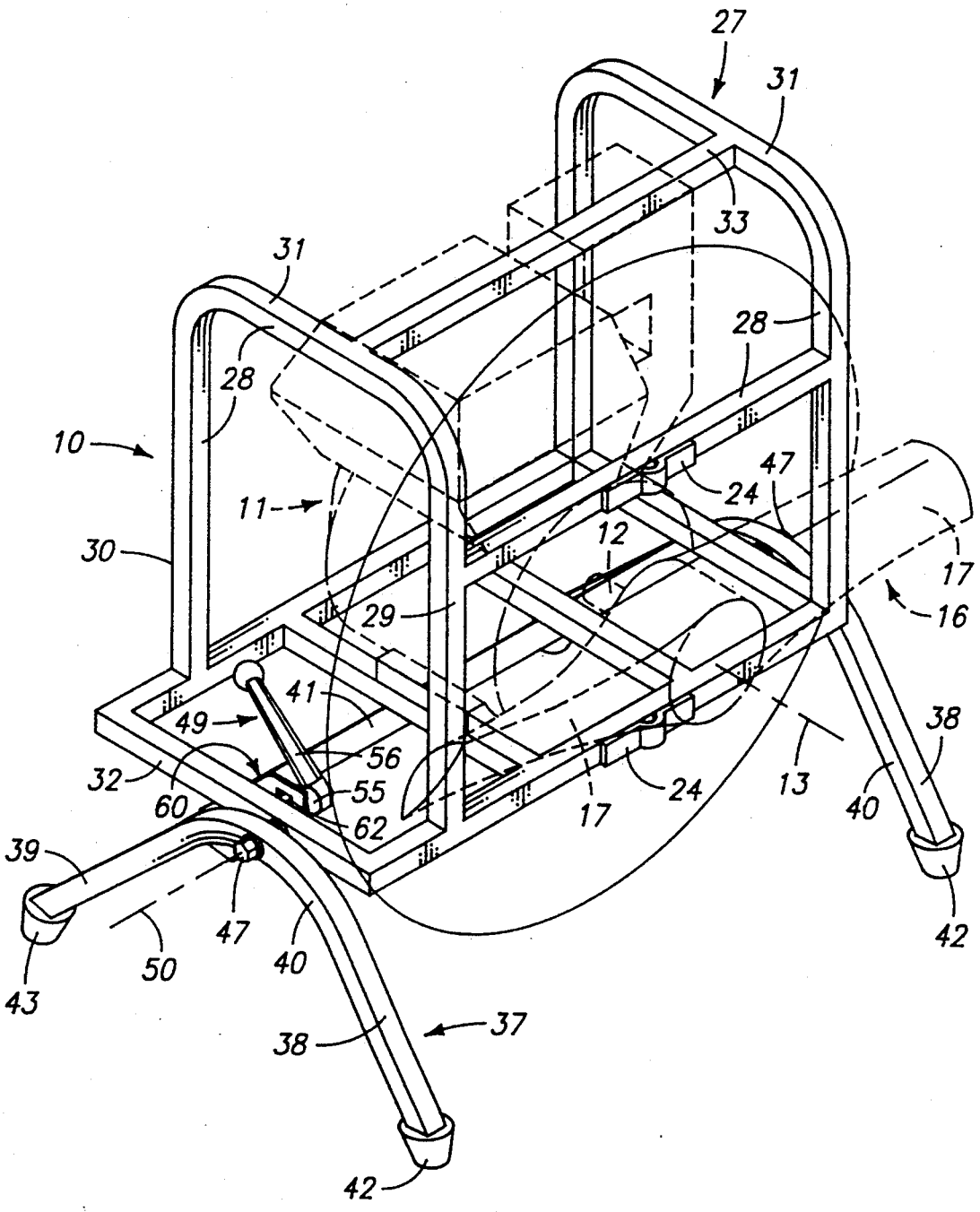
FIG. 1 is a perspective view of a and portable fire fighting positive pressure ventilation blower exemplifying features of the present invention, and in which the engine, propeller, and propeller guard are shown in phantom lines.

Referring now in detail to the drawings, there is illustrated in FIG. 1, a hand portable fire fighting, positive pressure blower generally designated by the numeral 10 for creating and directing a high velocity, wide cone stream of air into a smoke filled space of a burning structure.

In general terms, the blower 10 includes an engine 11. The engine is of conventional form, with a forwardly projecting drive shaft 12, rotatable about a drive shaft axis 13.

The engine drive shaft 12 mounts a unique propeller 16 that is rotated by the engine to produce a wide cone of forwardly directed air current. The propeller 16 includes opposed blades 17 that extend to blade ends 18. The pitch of the propeller is selected to produce maximum thrust or airflow in a forward direction away from the blower.

The angle or cone shape of the air current leaving the blower is influenced by sinuous concave or dished areas 19 along the forward facing surfaces of the blades 17. The areas 19 are situated along lengths of the blades 17, inward of the ends 18. These areas 19, along with the pitch of the propeller blades, serve to develop a relatively wide cone of air current that is extremely useful to facilitate positioning of the blower fairly close to a structure opening such as a door or window, etc., to "seal" the opening and to direct the air current into the structure for cooling and ventilation purposes. This is a distinct advantage over other blowers which direct a substantially confined air current flow through such openings and allow the remainder of the opening to permit undesired, unpredictable flow of air.

The propeller 16 is housed within a propeller guard 22. The propeller guard 22 is an open framework of rods that are closely spaced to permit passage of air, yet protect the propeller from foreign objects and users from coming into contact with the rapidly rotating blades. The propeller guard 22 includes a front face 23 that is the forward most projecting portion of the blower. The propeller guard is rigidly secured by mounting brackets 24 to a central frame 27.

The central frame 27 is a rigid network of frame elements 28 that form a cage around the engine 11. Frame elements 28 are joined as by welding, to form the cage configuration. The elements 28 together form a front portion 29 of the central frame 27, to which blade guard mounting brackets 24 are secured (FIG. 1).

The elements 28 also form a rear side 30, a top 31, and a bottom 32 of the central frame 27. One of the elements functions as a handle 33, extending across the top 31. The handle 33 serves a dual function of providing a hand grip surface for carrying the blower, and to protect the top portion of the engine. The remaining elements 28 are positioned strategically about the engine to provide rigidity for mounting the engine and protection should the blower be dropped or fall.

The central frame 27, as well as the remaining frame elements described below, are preferably formed of a rigid, yet lightweight material, such as stainless steel channel. The dimensions of the frame and channel may vary with the horsepower and physical size of the engine 11.

The central frame 27 is pivotably mounted on a rigid support frame 37. The rigid support frame 37 as generally shown in FIGS. 1-5, includes front legs 38 joined integrally to rear legs 39. The front and rear legs 38, 39 are formed in integral pairs and are situated to opposite longitudinal sides of the central frame 27.

Each integrally joined pair of front and rear legs is formed in an arcuate configuration, with the legs extending angularly from a top arched portion 40. The front legs 38 angle upward and rearwardly from front feet 42. The front leg angle in relation to the horizontal is within a range of 50° and 60°. A preferred angle is approximately 55°.

The rear leg 39 of each pair angles upwardly and forwardly from rear feet 43 at an angle to the horizontal within the range between 38° and 48°. The preferred angle for the rear legs is approximately 43°. The front and rear legs are joined by an arcuate midsection 40. Once again it is pointed out that the front legs 38, rear legs 39 and arcuate midsections 40 are integral.

The leg pairs are each preferably formed of a single piece of channel material constructed similarly to the elements of the central frame 27.

To provide additional rigidity, the support frame 37 includes a transverse cross member 41 rigidly connected between the rear legs 39. The cross member 41 provides lateral stability to the blower.

Figure 2:
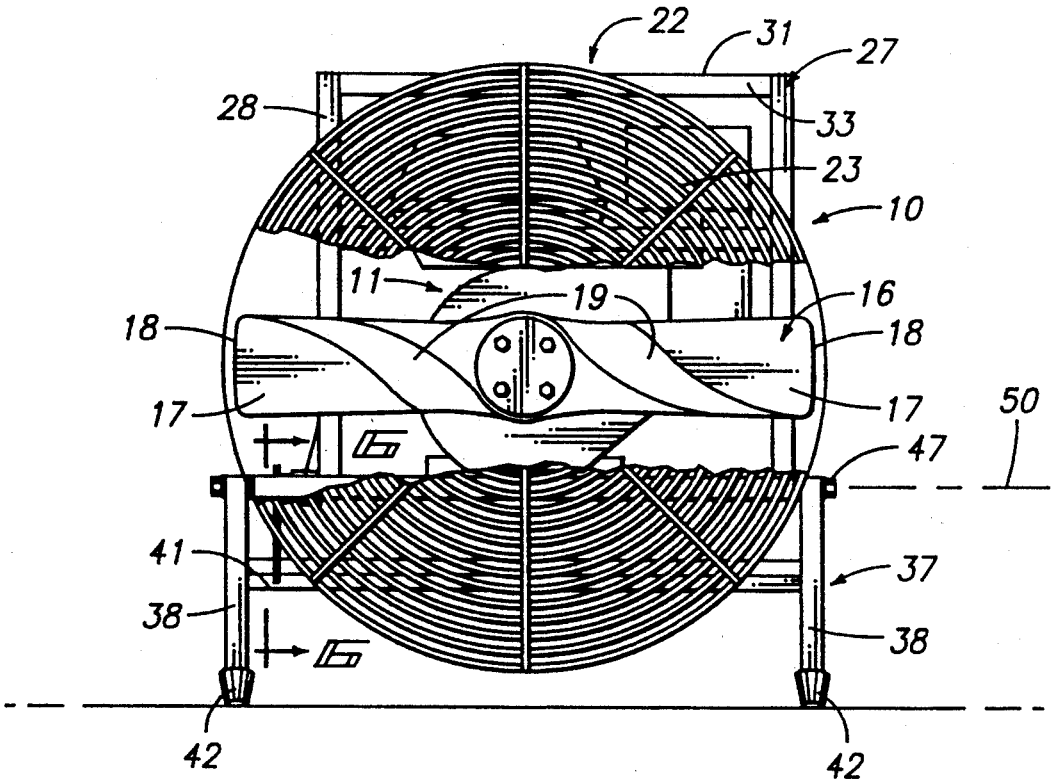
FIG. 2 is a front elevation view of the blower showing a portion of the propeller housing broken away.

It is pointed out, particularly with reference to FIG. 2 of the drawings, that the support frame 37 is also laterally confined to minimize the area occupied by the blower. That is, the legs 38, 39 are situated substantially within the diameter of the propeller guard 22 as shown in FIG. 2. This relationship affords sufficient stability, yet minimizes the overall dimensions of the blower to facilitate transport and storage.

The legs 38, 39 terminate at the front and rear feet 42, 43 which are positioned in nearly upright orientations. The feet 42, 43 are formed of a rubber material that is resilient to absorb vibrational energy transmitted through the legs from the engine and propeller. The rubber preferably has a durometer value of approximately 45-60 for this purpose.

The central frame 27 is joined at the bottom side 32 thereof to the support frame 37 by aligned pivots 47. The pivots 47 define a fixed adjustment axis 50 (FIGS. 1, 2, and 7) that is stationary on the blower and is situated below the drive shaft axis 13. Axis 50 is transverse with respect to the drive shaft axis and lies in a plane substantially parallel to the ground or other support surface.

Figure 3:
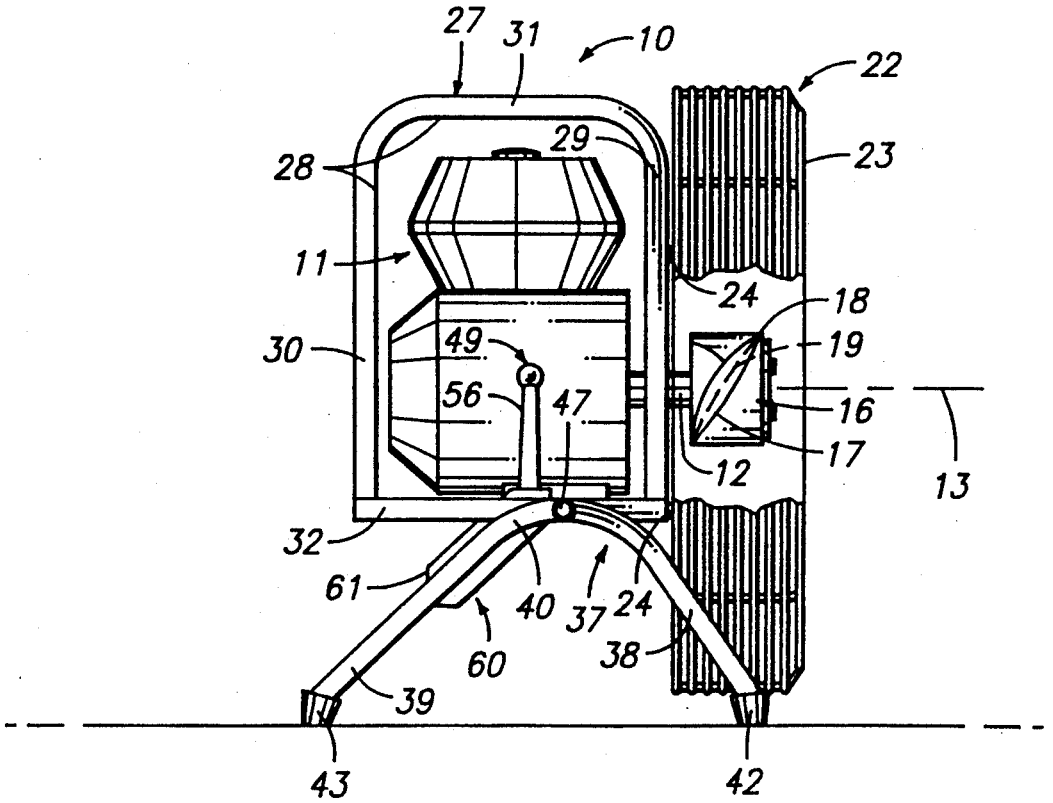
FIG. 3 is a side elevation view thereof with the engine and propeller shown in a horizontal orientation, again with a portion of the propeller guard broken away.

The adjustment axis 50 is situated with respect to the central frame 27 at a point of balance about the axis 50 when the frame, engine, propeller, and propeller guard are situated in a horizontal position as shown in FIG. 3. This relationship facilitates even distribution of weight to the feet 42, 43, and ease of adjustment for the device between the angular limits shown in FIGS. 4 and 5.

The pivots 47 are defined by pivot bolts 46 joining the central frame 27 and support frame 37 for relatively free pivotal movement. Such motion is encouraged by provision of permanently lubricated bushings 48 (FIG. 7)

on the bolts 46 between the support frame 37 and central frame 27.

In addition to the relationship of the adjustment axis 50 to the balance point for the central frame 27 and elements mounted thereto, a particular geometric relationship is provided between the adjustment axis 50 and the support frame 37. The adjustment axis 50 and support frame 37 are provided so that the distance from the front feet 42 to the adjustment axis 50 (distance "B",FIG. 4) is less than the distance from the rear feet 43 to the adjustment axis 50 (distance "A", FIG. 4).

Furthermore, both distances "A" and "B" are greater than the height dimension "C" from the support surface to the adjustment axis 50. This relationship, together with the relationship of the pivot axis to the central frame 27, enables a relatively small "foot print" for the blower, by providing a high degree of bracing stability during use, even when the blower is adjusted to any desired angle between limits set by a stop means to be described below.

Figure 4:
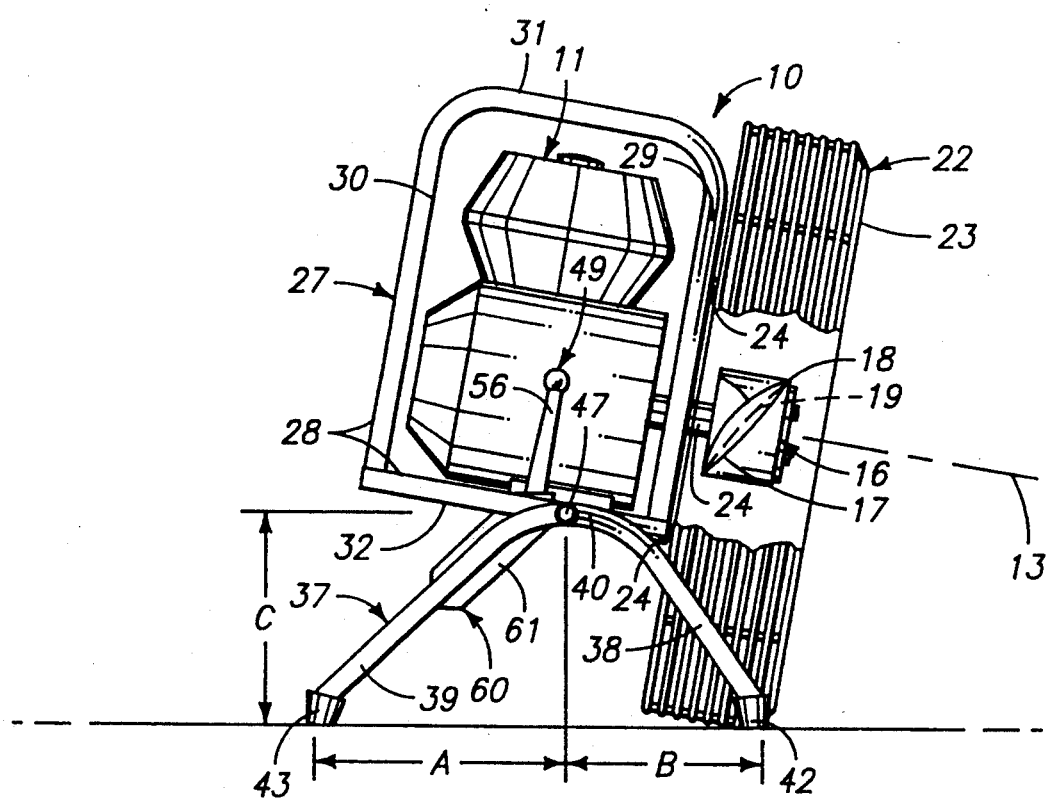
FIG. 4 is a view similar to FIG. 3 only showing the blower at a downward angled orientation.
Figure 5:
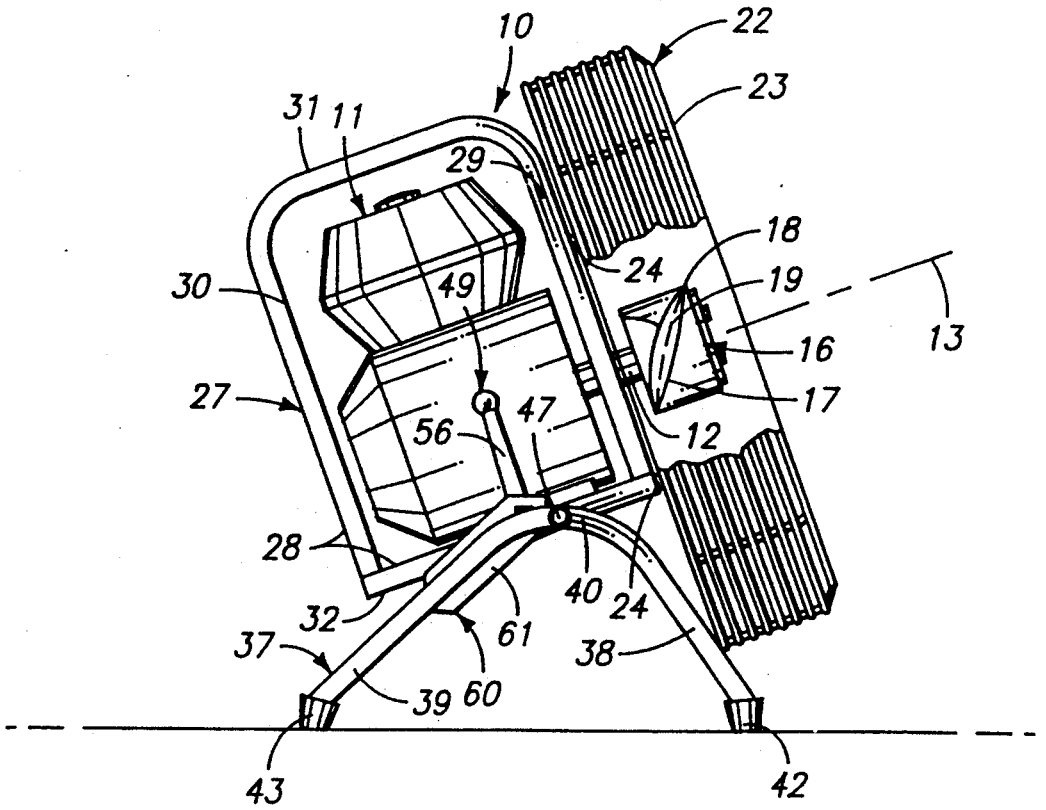
FIG. 5 is a view similar to FIGS. 3 and 4 only showing the blower in an upwardly angled position.

It may be noted by reference to FIGS. 3–5 that the front feet 42 are situated rearwardly of the propeller guard front face 23. Additionally, the rear feet 43 are situated closely adjacent to the rear side 30 of the central frame. This is the small "foot print" identified above and that is smaller than was previously known to be acceptable. However, the small span of the legs and feet along the rotational axis of the propeller and drive shaft is sufficient, given the relationships identified above, to facilitate secure support of the blower during operation. A user may operate the present blower 10 with confidence that it will not "walk" due to vibration, and that it will not blow itself over.

A pivot adjustment means 49 is connected between the support frame 37 and the central frame 27. Means 49 is selectively operable to secure the central frame 27 at a prescribed angle to the support frame.

The adjustment means 49 is shown in general within FIG. 1 and in greater detail in FIG. 7. It includes a threaded stud 54 that is secured to the central frame 27. The stud projects inwardly to threadably receive a friction clamp 55. The friction clamp 55 is provided in a preferred form with a ratchet device 56 that includes an internal rachet mechanism and an upstanding rachet handle. The clamp may be operated to clamp and release by selectively reciprocating or rocking the rachet handle through an arc to operatively clamp the central frame to the support frame. The handle may also be manipulated in a similar manner to release the central frame to pivot relatively freely in relation to the support frame. The ratchet arrangement is a conventional item, commercially available through Kipp/Elesa at 11001 Woodward in Bloomfield Hills, Mich. 48304.

A stop means 60 is provided, cooperating with the pivot adjustment means 49, to selectively limit angular positioning of the central frame with respect to the support frame 37. Specifically, the stop means 60 is provided to limit angular motion of the central frame to a total angular arc including approximately 40°. More specifically, the stop means is provided to limit upward angular positioning of the central frame to an upward limit of approximately 20° from the horizontal plane of the feet 42, 43, and a downward pivotal limit of approximately 20° from the normal, horizontal position indicated in FIG. 3. The upper limit is identified in FIG. 5 while the lower limit is shown in FIG. 4.

A bracket 61 with a slot 62 is provided for the above purposes. The bracket 61 is secured at one end to the support frame 37 and extends upward and forwardly to a position between the friction clamp 55 and the central frame 27. Thus, when the clamp is tightened, the bracket 61 is clamped tightly between the central frame 27 and the support frame 37, thereby locking the two frames together. When the clamp is loosened, the bracket is released and the two frames will pivot relatively freely on the adjustment axis.

Figure 6:
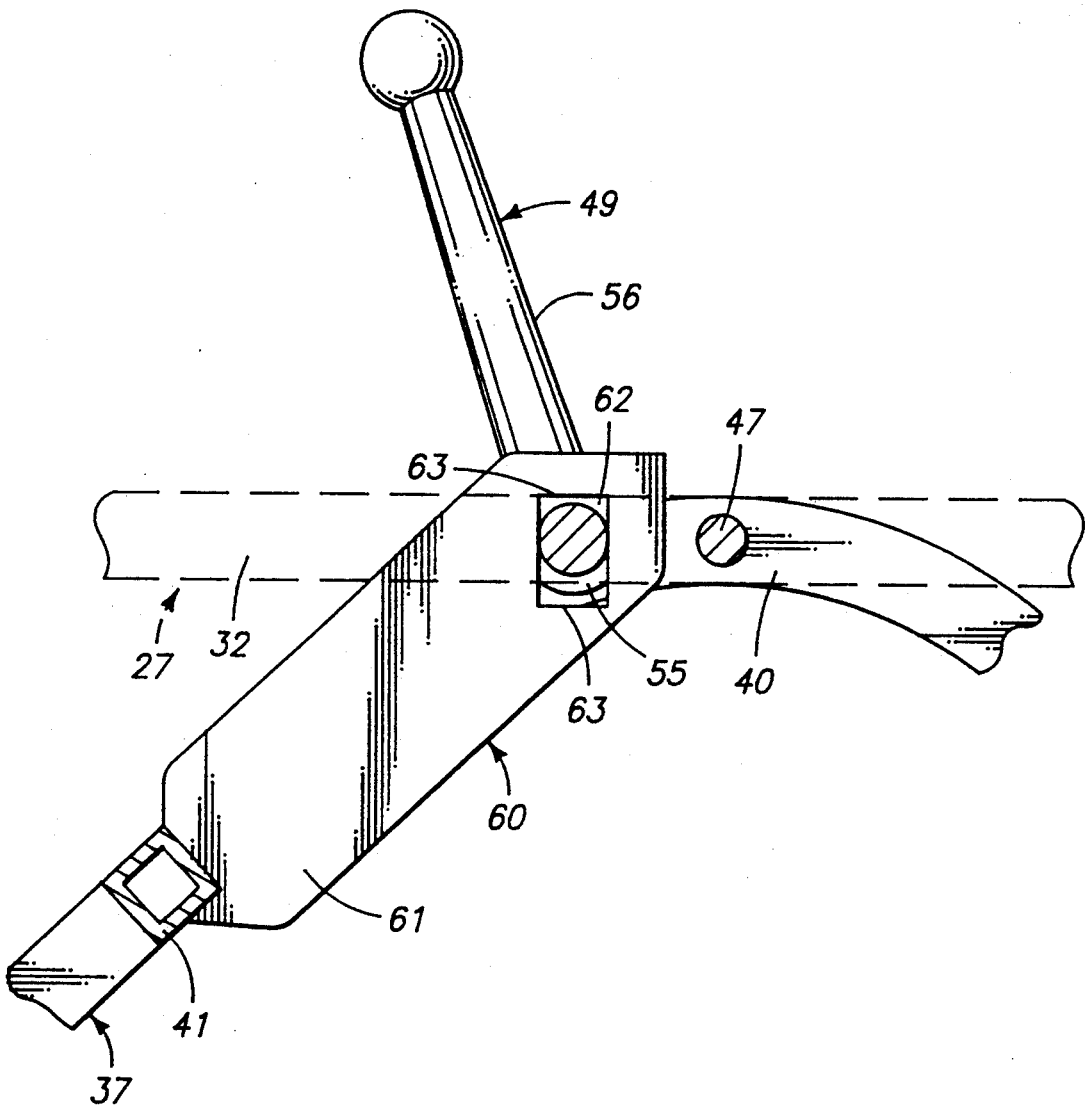
FIG. 6 is an enlarged fragmentary view of an angular adjustment means for the blower.
Figure 11:
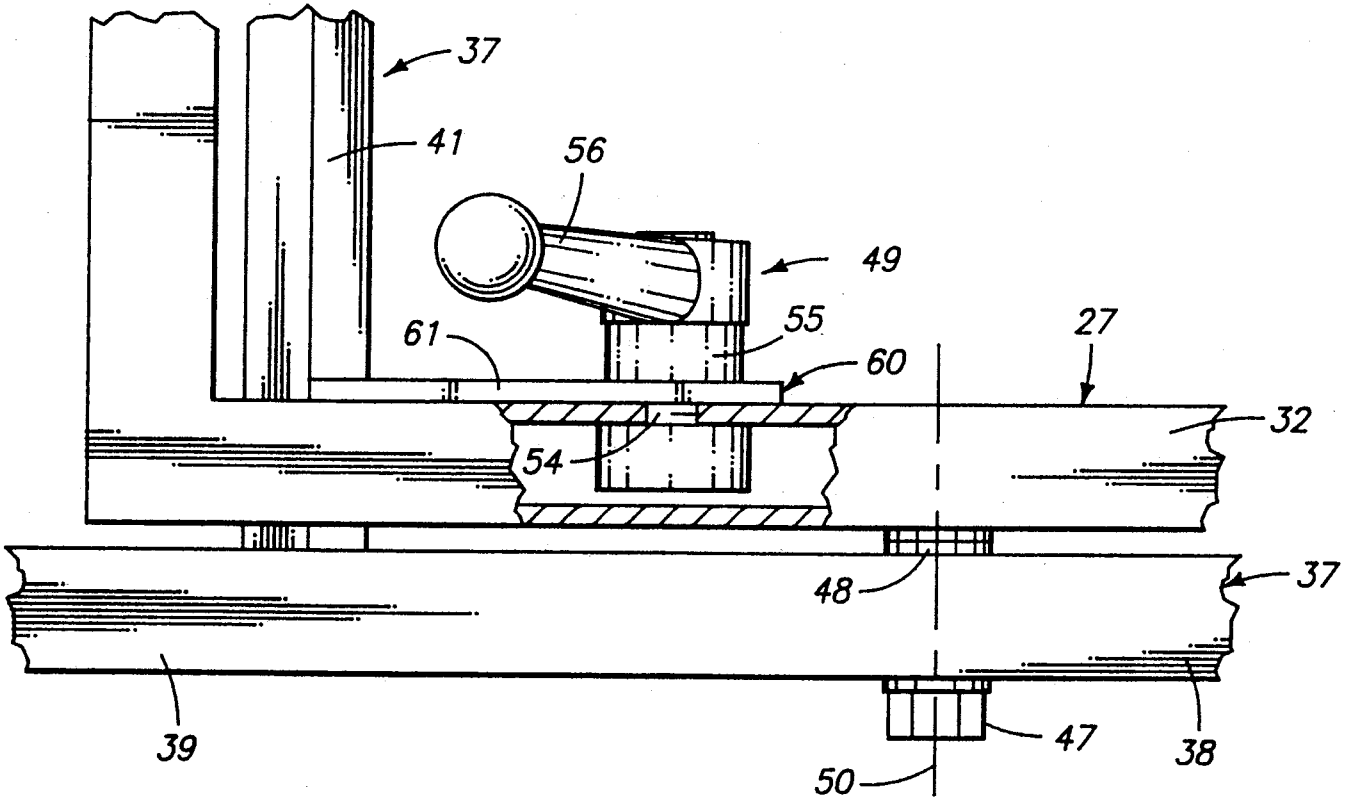

The bracket slot 62 slidably receives the threaded stud 54. Closed opposed ends 63 of the slot (FIG. 6) define the upper and lower pivotal limits for the central frame. Thus, the stud 54 will come into abutment with the slot end surfaces 63 at the upper and lower pivotal limits of the central frame. Of course, the angular position of the central frame may be infinitely adjusted and selectively locked in place between the angular limits by operation of the adjustment means as described above.

Prior to operation, the present blower 10 may be easily carried to the site of a burning structure by use of the handle 33. The blower 10 may be placed against the ground surface or other appropriate support surface with the four rubber feet 42, 43 engaging the ground.

The blower may be placed at a selected site in close proximity to an opening in the burning structure. This is due to the provision of the special propeller configuration, which will produce a wide cone of air current, spanning the desired opening.

The angle of the propeller drive shaft axis 13 is then adjusted by operation of the adjustment means 49 as described above. The engine may now be started and operation of the device to produce the desired air current commences with rotation of the propeller.

Air current is drawn into the propeller from behind and from areas to the sides of the propeller, due to the unique propeller configuration including the dished surfaces 19. A cone of air is produced by the rotating propeller that quickly expands, thereby occupying the desired opening size with the air current flow, sealing the opening of the structure against undesired, unpredictable air flow.

The blower will remain stable in operation due to the geometric relationship described above and the balance of the engine on the support frame. Additionally, the relatively soft rubber feet 42, 43 will absorb vibration of the engine and will permit the blower to remain in the selected position without "walking".

Another advantage recognized with the above frame configuration is the configuration of the legs which provide a relatively high ground clearance for the frame, so that obstructions on the ground surface may be "straddled" by the support frame.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A hand-portable fire fighting positive pressure blower, comprising:

an engine having a drive shaft rotatable about a drive shaft axis;

a positive pressure propeller mounted to the drive shaft;

a propeller guard enclosing the propeller and including a face surface forward of the propeller;

a central frame mounting the engine and propeller guard and having central frame elements forming a protective cage substantially surrounding the engine;

wherein the central frame includes top and bottom sides;

a support frame;

the support frame including forward and rearward legs extending to forward and rearward feet, the forward legs being joined integrally to the rearward legs in arcuate configurations to provide clearance between the legs and under the engine;

a pivot mounting the central frame to the support frame about an adjustment axis adjacent the bottom side of the central frame and situated downwardly of and substantially transverse to the drive shaft axis, for selectively enabling the central frame, engine, propeller, and propeller guard to pivot about the adjustment axis from a balanced position wherein the propeller axis is substantially horizontal;

adjustment means connected between the support frame and the central frame, selectively operable to secure the central frame at a prescribed angle to the support frame; and stop means for preventing pivotal movement of the central frame relative to the support frame beyond prescribed upward and downward angular limits.

2. A hand-portable fire fighting positive pressure blower, as claimed by claim 1 wherein the forward and rearward legs extend downward from the adjustment axis to the forward and rearward feet;

wherein the forward feet are situated forward of the adjustment axis and rearward of the propeller guard face; and wherein the rearward feet are situated rearward of the balance point.

3. A hand-portable fire fighting positive pressure blower, as claimed by claim 1 wherein:

the forward and rearward legs extend downward from the adjustment axis to the forward and rearward feet;

wherein the distance from the forward feet to the adjustment axis is less than the distance from the rearward feet to the adjustment axis.

4. A hand-portable fire fighting positive pressure blower, as claimed by claim 1 wherein the forward legs are angled upwardly and rearwardly from the forward feet at angles of approximately 50 to 60 degrees.

5. A hand-portable fire fighting positive pressure blower, as claimed by claim 1 wherein the rearward legs are angled upwardly and forwardly from the rearward feet at angles of approximately 38 to 48 degrees.

6. A hand-portable fire fighting positive pressure blower, as claimed by claim 1 wherein the rearward legs are angled upwardly and forwardly from the rearward feet at angles of approximately 43 degrees; and wherein the forward legs are angled upwardly and rearwardly from the forward feet at angles of approximately 55 degrees.

7. A hand-portable fire fighting positive pressure blower, as claimed by claim 1 wherein the adjustment means is located within the cage formed by the central frame.

8. A hand-portable fire fighting positive pressure blower, as claimed by claim 1 wherein the central frame includes a handle member at the top side thereof positioned over the engine.

9. A hand-portable fire fighting positive pressure blower, as claimed by claim 1 wherein the feet are formed of rubber having a durometer value of approximately 45–60.

10. A hand-portable fire fighting positive pressure blower, as claimed by claim 1 further comprising a blade guard rigidly mounted to the central frame, and wherein the engine is rigidly mounted to the central frame.

11. A hand-portable fire fighting positive pressure blower, comprising:

an engine having a drive shaft rotatable about a drive shaft axis;

a positive pressure propeller mounted to the drive shaft;

a propeller guard enclosing the propeller and including a face surface forward of the propeller;

a central frame mounting the engine and propeller guard and having central frame elements forming a protective cage substantially surrounding the engine;

wherein the central frame includes top and bottom sides;

a support frame;

a pivot mounting the central frame to the support frame about an adjustment axis adjacent the bottom side of the central frame and situated downwardly of and substantially transverse to the drive shaft axis, for selectively enabling the central frame, engine, propeller, and propeller guard to pivot about the adjustment axis from a balanced position wherein the propeller axis is substantially horizontal;

adjustment means connected between the support frame and the central frame, selectively operable to secure the central frame at a prescribed angle to the support frame, wherein the adjustment means includes a friction clamp for selectively locking the central frame to the support frame and;

stop means for preventing pivotal movement of the central frame relative to the support frame beyond prescribed upward and downward angular limits.

12. A hand-portable fire fighting positive pressure blower, as claimed by claim 11 wherein the friction clamp includes an upstanding operating lever for selectively locking the central frame to the support frame.

13. A hand-portable fire fighting positive pressure blower, as claimed by claim 11 wherein the friction clamp includes an upstanding ratchet lever means for selectively operating the friction clamp to lock the central frame to the support frame.

14. A hand-portable fire fighting positive pressure blower, as claimed by claim 11 wherein the friction clamp is spaced a radial distance from the adjustment axis, the friction clamp having an upstanding ratchet lever means for selectively operating the friction clamp to lock the central frame to the support frame.

15. A hand-portable fire fighting positive pressure blower, as claimed by claim 11 wherein the friction clamp is spaced a radial distance from the adjustment axis, the friction clamp having an upstanding ratchet lever means for selectively operating the friction clamp to lock the central frame to the support frame; and wherein the stop means permits angular movement of the central frame relative to the support frame through an angle of approximately 40 degrees.

16. A hand-portable fire fighting positive pressure blower, as claimed by claim 11 wherein the adjustment means further includes:

a threaded stud mounted to the central frame;

wherein the friction clamp threadably engages the stud; and wherein the stop means for preventing pivotal movement is comprised of a slotted bracket mounted to the support frame and extends between the friction clamp and the support frame receiving the threaded stud.

17. A hand-portable fire fighting positive pressure blower, as claimed by claim 11 wherein the adjustment means further includes a threaded stud mounted to the central frame wherein the stop means for preventing pivotal movement is comprised of a slotted bracket mounted to the support frame for receiving the threaded stud with stop surfaces positioned to stop pivotal movement of the central frame at approximately 20 degrees upward from a horizontal plane and at approximately 20 degrees downward from the horizontal plane.

* * * * *